US007431090B2

(12) United States Patent
Surjaatmadja et al.

(10) Patent No.: US 7,431,090 B2
(45) Date of Patent: Oct. 7, 2008

(54) METHODS AND APPARATUS FOR MULTIPLE FRACTURING OF SUBTERRANEAN FORMATIONS

(75) Inventors: Jim B. Surjaatmadja, Duncan, OK (US); Billy W. McDaniel, Duncan, OK (US); Mark Farabee, Houston, TX (US); David Adams, Midland, TX (US); Loyd East, Tomball, TX (US)

(73) Assignee: Halliburton Energy Services, Inc., Duncan, OK (US)

( * ) Notice: Subject to any disclaimer, the term of this patent is extended or adjusted under 35 U.S.C. 154(b) by 17 days.

(21) Appl. No.: 11/158,484

(22) Filed: Jun. 22, 2005

(65) Prior Publication Data

US 2006/0289167 A1 Dec. 28, 2006

(51) Int. Cl.
*E21B 43/26* (2006.01)

(52) U.S. Cl. ..... 166/308.1; 166/271; 166/259

(58) Field of Classification Search ..... None
See application file for complete search history.

(56) References Cited

U.S. PATENT DOCUMENTS

| | | | | |
|---|---|---|---|---|
| 3,058,521 | A | 10/1962 | Gilbert | |
| 3,130,786 | A | 4/1964 | Brown et al. | |
| 3,393,736 | A | 7/1968 | Goodwin | |
| 4,974,635 | A | 12/1990 | Hanus et al. | |
| 5,499,678 | A | 3/1996 | Surjaatmadja et al. | |
| 5,765,642 | A | 6/1998 | Surjaatmadja | |
| 6,006,838 | A | 12/1999 | Whiteley et al. | |
| 6,286,600 | B1 | 9/2001 | Hall et al. | |
| 6,644,407 | B2 * | 11/2003 | Arnold, III | 166/308.1 |
| 2003/0062167 | A1 | 4/2003 | Surjaatmadja et al. | |
| 2005/0263284 | A1 * | 12/2005 | Justus | 166/281 |
| 2006/0070740 | A1 * | 4/2006 | Surjaatmadja et al. | 166/308.1 |

FOREIGN PATENT DOCUMENTS

WO WO 2005/059305 A1 6/2005

OTHER PUBLICATIONS

Foreign communication related to a counterpart application dated Jul. 27, 2006.

* cited by examiner

*Primary Examiner*—Jennifer H Gay
*Assistant Examiner*—Angela M DiTrani
(74) *Attorney, Agent, or Firm*—John W. Wustenberg; McAfee & Taft

(57) ABSTRACT

The invention relates to methods and apparatus for creating multiple fractures in subterranean formations. The apparatus is a jetting tool having a plurality of sets of jetting nozzles so that the sets of nozzles are substantially parallel to one another such that parallel cavities may be formed substantially simultaneously in the formation. The jetting nozzles may be adapted to provide a fluid jet that flares outwardly from the nozzle. The nozzles also may be aligned such that cavities in the formation overlap to form a single cavity. The nozzles may be further adapted so that holes jetted into the casing thereby are still spaced from one another. Methods of fracturing subterranean formations using the apparatus are also disclosed.

18 Claims, 3 Drawing Sheets

METHODS AND APPARATUS FOR MULTIPLE FRACTURING OF SUBTERRANEAN FORMATIONS

BACKGROUND

The present invention relates to fracturing of subterranean formations, such as in a well, by hydrojetting fluid from a jetting tool, and more particularly, to methods and apparatus for creating multiple fractures in a formation using such tools at substantially the same time.

Hydraulic fracturing is often utilized to stimulate the production of hydrocarbons from subterranean formations penetrated by wellbores. In performing hydraulic fracturing treatments, a portion of a formation to be fractured is isolated using convention packers or the like, and a fracturing fluid is pumped through the wellbore into the isolated portion of the formation to be stimulated at a rate and pressure such that fractures are formed and extended in the formation. Propping agents function to prevent the fractures from closing and thereby provide conductive channels in the formation through which produced fluids can readily flow to the wellbore.

In wells penetrating very low to medium permeability formations, and wells not producing to expectations, it is often desirable to create fractures in the formations near the wellbores in order to improve hydrocarbon production from the formations. In order to create such fractures in formations penetrated by cased or open hole wellbores conventionally, a sealing mechanism such as one or more packers must be utilized to isolate the portion of the subterranean formation to be fractured. When used in open hole wellbores, such sealing mechanisms are not as effective, as fractures tend to create open passages past the sealing mechanism. In cased wells, sealing mechanisms are effective; but their use and installation are time consuming and add considerable expense to the fracturing treatment.

As a solution to this problem, a unique stimulation technique was formulated. This technique does not require sealing mechanisms; instead, sealing is performed dynamically. That is, sealing is achieved using velocity of the fluid. This method was disclosed in U.S. Pat. No. 5,765,642. Using this method, fractures are created one at a time. However, sometimes there are situations where a few fractures must be created at the same time. In U.S. Pat. No. 5,765,642, the jet nozzles are placed such that they are located on the same plane while jet direction is also on the same plane. Therefore, placing jet nozzles on multiple parallel planes would be desirable for simultaneous placement of such multiple fractures. Note that, if the parallel planes are too close to each other, it will cause a single fracture to occur.

Thus, there is a need for improved methods of treating formations to improve hydrocarbon production therefrom which are relatively simple and inexpensive to perform.

SUMMARY

The present invention includes methods and apparatus for creating substantially parallel fractures in a well formation.

Generally, the present invention includes a tool for jetting a formation in a cased well. The tool comprises a housing adapted for connection to a tool string, a plurality of sets of jetting nozzles disposed on the housing wherein the sets of jetting nozzles are substantially parallel to one another such that parallel cavities may be formed substantially simultaneously in a well formation.

In one embodiment, the jetting nozzles are adapted to provide a fluid jet that flares outwardly from the nozzle, and the jetting nozzles are aligned such that cavities in the formation overlap to form substantially a single cavity radially outward from casing in the well. The jetting nozzles are further adapted so that holes spaced from one another are jetted through the casing.

Preferably, the jetting nozzles are arranged in a plurality of substantially parallel planes. The jetting nozzles are disposed in a plurality of jetting heads spaced from one another.

The present invention also includes a method of placing controlled fractures in a well formation comprising the steps of (a) providing a tool string with a plurality of jetting heads thereon wherein the jetting heads are spaced from one another, (b) lowering the tool string into a well such that each of the jetting heads is adjacent to a desired fracturing location, and (c) jetting fluid from jetting nozzles in the jetting heads to place fractures spaced from one another at the desired locations substantially simultaneously. The jetting heads are preferably separated along the tool string by a predetermined distance. This distance may be a function of the hardness of the formation at the locations to be fractured. The distance is relatively larger for formations having a relatively higher hardness than the distance for formations having a relatively lower hardness.

Step (a) preferably comprises positioning a spacer between adjacent sets of jetting heads. The jetting heads may be of a type similar or the same as those used by Halliburton Energy Services, Inc. in its SURGIFRAC fracturing service.

The present invention may also include a method of fracturing a formation in a cased well comprising the steps of (a) providing a tool string with a jetting tool thereon wherein the jetting tool has jetting nozzles disposed in a plurality of substantially parallel planes, (b) lowering the tool string into a well such that the jetting head is adjacent to a desired location, and (c) jetting fluid from jetting nozzles such that cavities in the formation at the desired location overlap into one generally coplanar cavity. The coplanar cavity is preferably radially outward of the casing.

In one embodiment, the cavities jetted into the formation are in the range of about 2 to about 4 inches in diameter. Step (c) preferably comprises the jetting nozzles forming holes in the casing which are spaced from one another and not overlapping. The holes are preferably about 0.5 inches in diameter.

The jetting nozzles in each of the layers may be staggered with respect to the jetting nozzles in any adjacent layer. The layers may be substantially perpendicular to a longitudinal axis of the well, or they may be disposed at an acute angle with respect to a longitudinal axis of the well.

The coplanar cavities may be formed substantially simultaneously.

Numerous objects and advantages of the invention will become apparent as the following detailed description of exemplary embodiments is read in conjunction with the drawings illustrating such embodiments.

DETAILED DESCRIPTION

Figure 1:
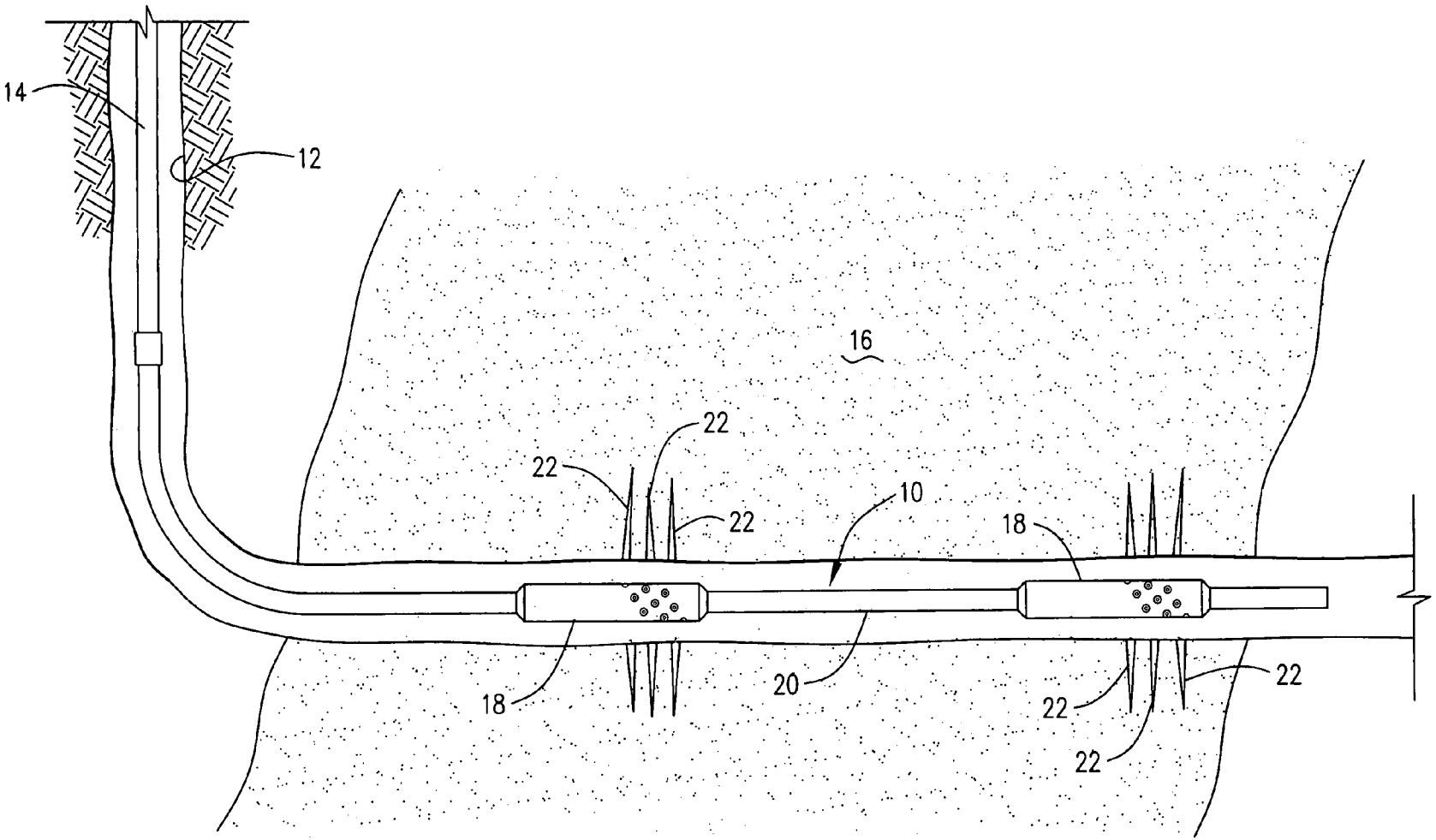
FIG. 1 shows a first embodiment of the apparatus for fracturing subterranean formations of the present invention.

Referring now to the drawings, and more particularly to FIG. 1, a first embodiment of the tool or apparatus for fracturing subterranean formations of the present invention is shown and generally designated by the numeral 10. Tool 10 is lowered into a wellbore 12 on a tool string 14 of a kind generally known until tool 10 is adjacent to a formation or zone of interest 16.

Tool 10 comprises a plurality of hydrojetting tools 18 separated by a spacer 20 of predetermined length. Hydrojetting tools 18 are of a kind known in the art, such as used by Halliburton Energy Services, Inc. in its SURGIFRAC fracturing service. While two hydrojetting tools 18 are shown herein, more than a pair of such tools could be used.

Each hydrojetting tool 18 is designed to jet fluid therefrom to form a set of fractures 22 in formation 16. The length of spacer 20 is determined by the desired distance between each set of fractures 22. The minimum distance that allows such formation of multiple sets of fractures 22 is a function of the hardness of formation 16. That is, the harder formation 16, the closer sets of fractures 22 can be to one another. For softer formations, the spacing must be relatively greater.

In operation of tool 10, tool string 14 is made up as shown with multiple hydrojetting tools 18 therein. Tool string 14 is lowered into wellbore 12 until tool 10 is adjacent to the desired formation 16. Fluid is jetted out of hydrojetting tools 18 to form multiple sets of fractures 22 substantially simultaneously. In this way, only one trip into wellbore 12 is usually necessary, and movement of the tool 10 to form multiple fractures is not required. This reduces the time for carrying out the operation and thus minimizes the cost thereof.

Figure 2:
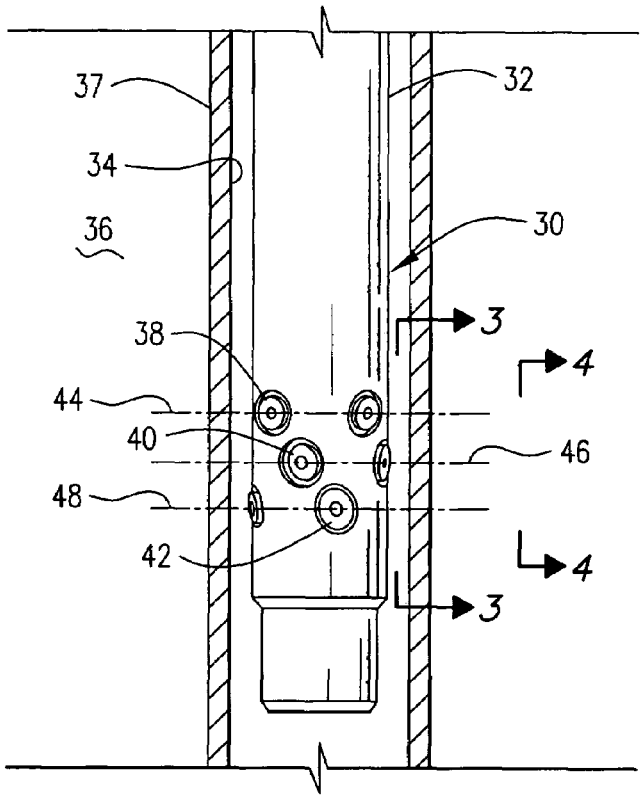
FIG. 2 shows a second embodiment of the present invention used to fracture a formation in parallel planes substantially perpendicular to an axis of the wellbore.

Referring now to FIG. 2, a second embodiment of the invention is shown and generally designated by the numeral 30. Tool 30 is mounted on a tool string 32 positionable in wellbore 34 adjacent to a formation or zone of interest 36. Wellbore 34 may have a casing 37 therein.

Tool 30 has a plurality of jetting nozzles 38, 40 and 42 thereon which are aligned such that they can jet fluid in a plurality of substantially parallel planes 44, 46 and 48, respectively.

In using prior art hydrojetting tools, when there are too many jetting nozzles used in the same plane, there is a risk that the strength of the tool may be compromised. An even more serious problem is that the jetting action can actually cut the well casing in half. With tool 30, a plurality of layers of staggered jetting nozzles 38, 40 and 42 are used. For example, jetting nozzles 38 are in single plane 44 and staggered with respect to jetting nozzles 40 in adjacent plane 46. Similarly, jetting nozzles 40 are in single plane 46 and staggered with respect to jetting nozzles 42 in adjacent plane 48.

Figure 3:
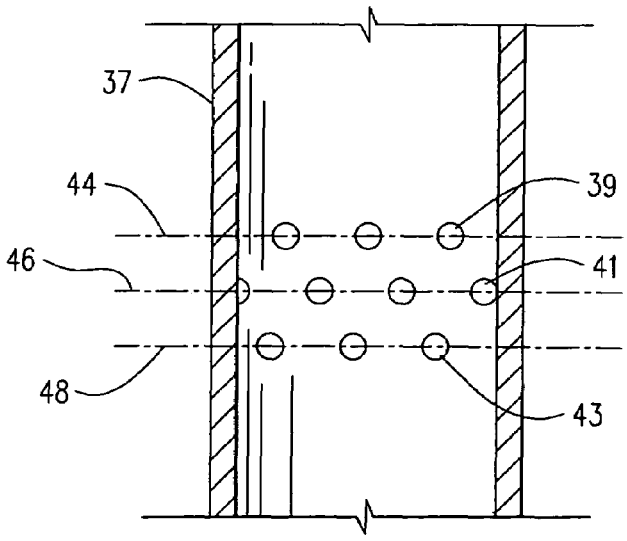
FIG. 3 is a cross section of the well casing taken along lines 3-3 in FIG. 2.

Jetting nozzles 38, 40 and 42 are preferably relatively small, such as about 0.25 inches in diameter. This will result in holes 39, 41 and 43, respectively, being cut in casing 37 as shown in FIG. 3. Holes 39, 41 and 43 are preferably about 0.5 inches in diameter. By properly spacing jetting nozzles 38, 40 and 42 and planes 44, 46 and 48, holes 39, 41 and 43 cut in casing 37 will not overlap, and thus the casing 37 will not be cut in half.

Figure 4:
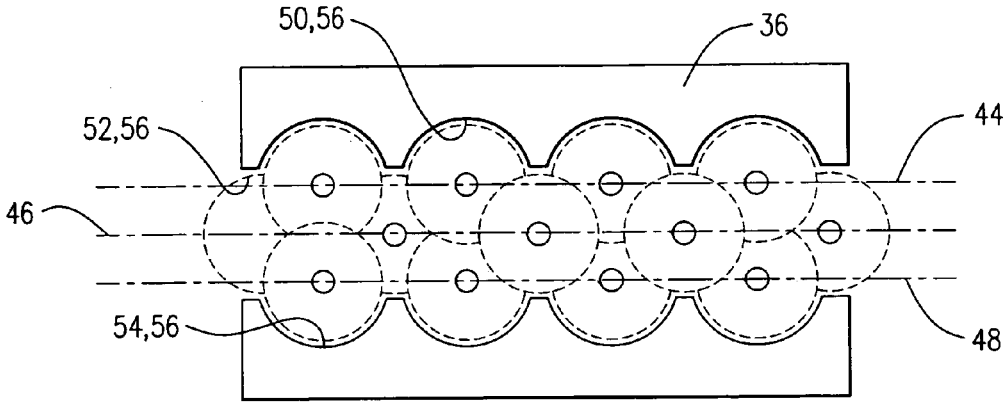
FIG. 4 illustrates a cavity formed by the second embodiment taken along lines 4-4 in FIG. 2.

However, referring now to the well formation 36 cross section shown in FIG. 4, the fluid jetted from jetting nozzles 38, 40 and 42 will continue to flare outwardly to form cavities 50, 52 and 54, respectively, which will overlap outward of casing 37. That is, those skilled in the art will see that jetting nozzles 38 form a plurality of overlapping cavities 50. Similarly, jetting nozzles 40 form a plurality of overlapping cavities 52, and jetting nozzles 42 form a plurality of overlapping cavities 54. Planes 44, 46 and 48 are spaced such that cavities 50 overlap with cavities 52, and cavities 52 overlap with cavities 54. All of overlapping cavities 50, 52 and 54 will be seen to form a single large cavity 56 in formation 36.

Preferably, cavities 50, 52 and 54 will be from about 2 inches to about 4 inches in diameter at the point at which they overlap. Because the overlapping area is radially outward of casing 37, cavity 56 can be formed to a desired size without destructive damage to casing 37.

Figure 5:
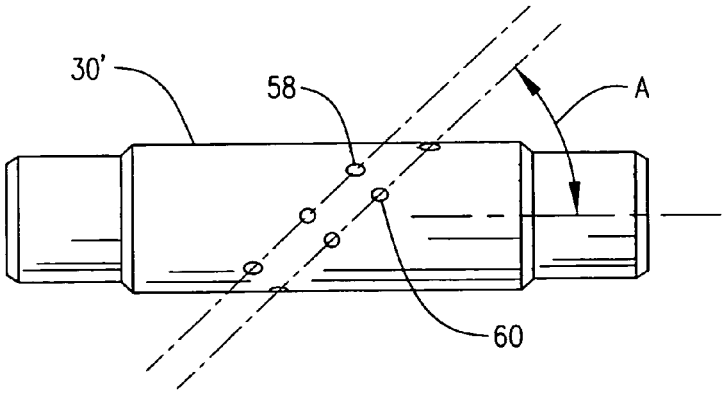
FIG. 5 is a variation of the second embodiment in which the parallel planes are angularly disposed with respect to the axis of the wellbore.

As shown in FIGS. 2-4, planes 44, 46 and 48 are substantially perpendicular to the longitudinal axis of wellbore 34. However, there may be occasions where it is desired to jet the fluid so that the planes are at an angle other than a right angle to the wellbore 34 axis. An example of such an angular relationship is shown in FIG. 5 in which a jetting tool 30' has sets of jetting nozzles 58 and 60 shown at an acute angle A to the axis of the wellbore 34. While two sets of jetting nozzles 58 and 60 are shown, those skilled in the art will see that additional sets of jetting nozzles may be added and the jetting nozzles staggered to form any desired pattern of overlapping cavities in the well formation.

It will be seen, therefore, that the methods and apparatus for multiple fracturing in subterranean well formations are well adapted to carry out the ends and advantages mentioned as well as those inherent therein. While presently preferred embodiments of the methods and apparatus have been shown for the purposes of this disclosure, numerous changes in the steps in the methods and parts in the apparatus may be made by those skilled in the art. All such changes are encompassed within the scope and spirit of the appended claims.

What is claimed is:

1. A tool for jetting a formation in a well, comprising:

a plurality of jetting heads spaced from one another and adapted for connection to a tool string, wherein each jetting head comprises:

a housing;

a plurality of layers of staggered jetting nozzles disposed on the housing, wherein the layers of jetting nozzles are substantially parallel to one another such that parallel cavities may be formed substantially simultaneously in the formation, the jetting nozzles being aligned such that cavities in the formation overlap to form substantially a single cavity radially outward from a casing in the well; and wherein the jetting nozzles are adapted to provide a fluid jet that flares outwardly from the jetting nozzle and are further adapted such that holes are jetted through the casing such that the holes are spaced from one another.

2. The tool of claim 1 wherein the jetting nozzles are arranged in a plurality of substantially parallel planes.

3. A method of placing controlled fractures in a formation in a well comprising the steps of:

(a) providing a tool string with a plurality of jetting heads thereon, wherein the jetting heads are spaced from one another;

(b) lowering the tool string into the well such that each of the jetting heads is adjacent to a desired fracturing location;

(c) jetting fluid from jetting nozzles in the jetting heads to place fractures spaced from one another at the desired locations substantially simultaneously, wherein the jetting heads are separated along the tool string by a predetermined distance; and wherein the distance is a function of the hardness of the formation at the locations to be fractured.

4. The method of claim 3 wherein the distance is relatively larger for formations having a relatively higher hardness than the distance for formations having a relatively lower hardness.

5. The method of claim 3 wherein step (a) comprises positioning a spacer between adjacent sets of jetting heads.

6. A method of fracturing a formation penetrated by a cased well comprising the steps of:

(a) providing a tool string with a jetting tool therein, wherein the jetting tool has jetting nozzles disposed in a plurality of substantially parallel planes, the jetting nozzles in one plane being staggered relative to the jetting nozzles in an adjacent plane;

(b) lowering the tool string into a well such that the jetting tool is adjacent to a desired location; and (c) jetting fluid from the jetting nozzles to form holes in the casing which are spaced from one another, wherein the holes are about 0.5 inches in diameter, wherein the fluid is jetted from the jetting nozzles such that cavities form in the formation at the desired location and overlap into one single large cavity and, wherein a plurality of such single large cavities are formed substantially simultaneously.

7. The method of claim 6 wherein the cavities jetted into the formation are in the range of about 2 to about 4 inches in diameter.

8. The method of claim 6 wherein the parallel planes are substantially perpendicular to a longitudinal axis of the well.

9. The method of claim 6 wherein the parallel planes are disposed at an acute angle with respect to a longitudinal axis of the well.

10. A tool for jetting a formation in a well, comprising:

a plurality of jetting heads spaced from one another and adapted for connection to a tool string, wherein each jetting head comprises:

a housing; and a plurality of layers of staggered jetting nozzles disposed on the housing, wherein the layers of jetting nozzles are substantially parallel to one another such that parallel cavities may be formed substantially simultaneously in the formation, the jetting nozzles being aligned such that cavities in the formation overlap to form substantially a single cavity radially outward from a casing in the well.

11. The tool of claim 10, wherein the jetting nozzles are adapted to provide a fluid jet that flares outwardly from the jetting nozzle.

12. The tool of claim 10 wherein the jetting nozzles are arranged in a plurality of substantially parallel planes.

13. A method of fracturing a formation penetrated by a cased well comprising the steps of:

(a) providing a tool string with a jetting tool therein, wherein the jetting tool has jetting nozzles disposed in a plurality of substantially parallel planes, the jetting nozzles in one plane being staggered relative to the jetting nozzles in an adjacent plane;

(b) lowering the tool string into a well such that the jetting tool is adjacent to a desired location; and (c) jetting fluid from the jetting nozzles to form holes in the casing which are spaced from one another, wherein the holes are about 0.5 inches in diameter, wherein the fluid is jetted from the jetting nozzles such that cavities form in the formation at the desired location and overlap into one single large cavity.

14. The method of claim 13 wherein the parallel planes are substantially perpendicular to a longitudinal axis of the well.

15. The method of claim 13 wherein a plurality of single large cavities are formed substantially simultaneously.

16. The method of claim 13 wherein the single large cavity is radially outward of the casing.

17. The method of claim 13 wherein the cavities jetted into the formation are in the range of about 2 to about 4 inches in diameter.

18. The method of claim 13 wherein the parallel planes are disposed at an acute angle with respect to a longitudinal axis of the well.

* * * * *